US008032037B2

(12) United States Patent
Kitazawa et al.

(10) Patent No.: US 8,032,037 B2
(45) Date of Patent: Oct. 4, 2011

(54) IMAGE FORMING APPARATUS, COMPUTER PROGRAM PRODUCT, AND PRINTING INHIBITING METHOD

(75) Inventors: Toshio Kitazawa, Chiba (JP); Tomoyuki Takahira, Kanagawa (JP); Satoshi Miyazaki, Kanagawa (JP); Hideaki Matsui, Kanagawa (JP); Kazuma Saitoh, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 451 days.

(21) Appl. No.: 12/285,547

(22) Filed: Oct. 8, 2008

(65) Prior Publication Data

US 2009/0116854 A1 May 7, 2009

(30) Foreign Application Priority Data

Nov. 2, 2007 (JP) ..... 2007-286036

(51) Int. Cl.
*G03G 15/00* (2006.01)
*G03G 21/00* (2006.01)

(52) U.S. Cl. ..... 399/12; 399/81

(58) Field of Classification Search ..... 399/12, 399/111, 110, 79, 81, 82; 347/19, 49, 86
See application file for complete search history.

(56) References Cited

U.S. PATENT DOCUMENTS

| | | | | |
|---|---|---|---|---|
| 6,011,935 | A * | 1/2000 | Matsuzaka et al. | 399/12 |
| 6,909,856 | B2 | 6/2005 | Crichton | 399/12 |
| 7,027,744 | B2 * | 4/2006 | Simpson et al. | 399/12 |
| 7,516,318 | B2 | 4/2009 | Eun | 713/1 |
| 2006/0245767 | A1 * | 11/2006 | Burchette et al. | 399/12 |
| 2007/0140722 | A1 * | 6/2007 | Kobayashi et al. | 399/81 |
| 2009/0116854 | A1 | 5/2009 | Kitazawa et al. | 399/12 |

FOREIGN PATENT DOCUMENTS

| | | |
|---|---|---|
| JP | 10-151832 | 6/1998 |
| JP | 10-161508 | 6/1998 |
| JP | 2004-013904 | 1/2004 |

OTHER PUBLICATIONS

Notice of Allowance dated Feb. 11, 2011 for corresponding U.S. Appl. No. 12/285,956.

* cited by examiner

*Primary Examiner* — Sophia S Chen
(74) *Attorney, Agent, or Firm* — Harness, Dickey & Pierce, P.L.C.

(57) ABSTRACT

A cartridge used for image formation is detachably accommodated in a main body of an image forming apparatus. A cartridge determining unit determines a cartridge type, which is a type of the cartridge, and a print-job determining unit determines a print job type, which is a type of a print job received from an external device. If the print job type and the cartridge type do not match, an inhibiting unit inhibits an image formation process.

23 Claims, 9 Drawing Sheets

| PRINT JOB TYPE / CARTRIDGE TYPE | NORMAL | MICR |
|---|---|---|
| NORMAL | ALLOWED | INHIBITED |
| MICR | ALLOWED | ALLOWED |

IMAGE FORMING APPARATUS, COMPUTER PROGRAM PRODUCT, AND PRINTING INHIBITING METHOD

CROSS-REFERENCE TO RELATED APPLICATIONS

The present application claims priority to and incorporates by reference the entire contents of Japanese priority document 2007-286036 filed in Japan on Nov. 2, 2007.

BACKGROUND OF THE INVENTION

1. Field of the Invention

The present invention relates to a technology for controlling printing process based on print job type and process cartridge type in an image forming apparatus.

2. Description of the Related Art

A system that prints checks in a unique font type called a magnetic ink character recognition (MICR) font that uses magnetic ink or a magnetic toner, and performs reading and sorting of the checks using an apparatus called an MICR reader-sorter is being widely used in Western and other countries.

SUMMARY OF THE INVENTION

It is an object of the present invention to at least partially solve the problems in the conventional technology.

According to an aspect of the present invention, there is provided an image forming apparatus that includes a main body that detachably accommodates a cartridge that is used for image formation; a cartridge determining unit that determines a cartridge type being a type of a cartridge accommodated in the main body; a print-job determining unit that determines a print job type being a type of a print job received from an external device; and an inhibiting unit that inhibits, if the print job type and the cartridge type do not match, an image formation process.

According to another aspect of the present invention, there is provided a printing inhibiting method that includes determining a cartridge type being a type of a cartridge that is detachably accommodated in a main body for use in image formation; determining a print job type being a type of a print job received from an external device; and inhibiting, if the print job type and the cartridge type do not match, an image formation process.

According to still another aspect of the present invention, there is provided a computer program product that implements the above method on a computer.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

The embodiments are examples in which a laser printer is applied as an image forming apparatus.

Figure 1:
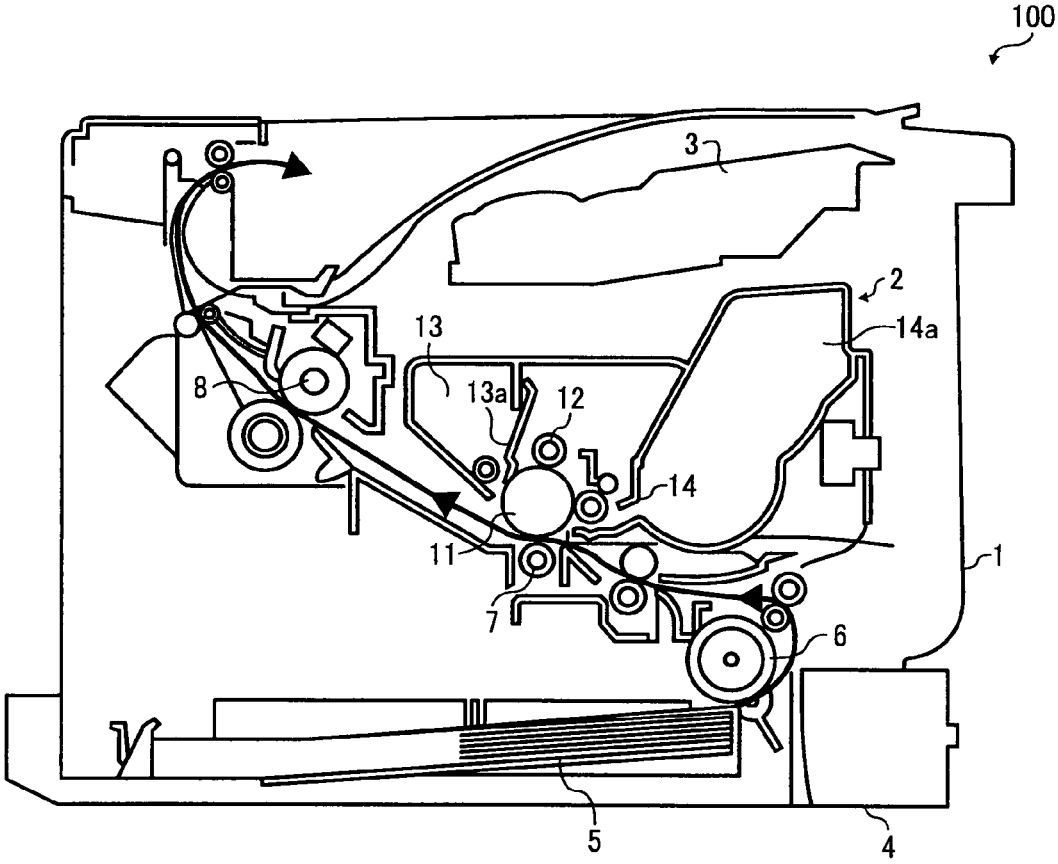
FIG. 1 is a schematic diagram of an internal structure of a laser printer according to an embodiment of the present invention.

FIG. 1 is a schematic diagram of an internal structure of a laser printer 100 according to an embodiment of the present invention. The laser printer 100 accommodates a detachable process cartridge 2 in a main body 1. The process cartridge 2 integrally includes a photosensitive body 11, an electrostatic roller 12, a waste-toner collecting unit 13 that includes a cleaning unit 13*a*, a developing unit 14 that includes a toner storage unit 14*a* etc. (all-in-one). An electrophotographic process is carried out using the structural components mentioned above.

The laser printer 100 further includes in the main body 1 an optical writing unit 3 that writes image data on the photosensitive body 11 using light beams. The optical writing unit 3 includes a polygon motor, a polygon mirror, an Fθ lens, a laser diode, a mirror etc., which are not shown. Furthermore, the laser printer 100 includes in the main body 1 a sheet feeding tray 4, a pickup roller 6, a transfer roller 7, a fixing roller 8 etc., which will be described in detail below with explanation about operations of the laser printer 100.

Figure 2:
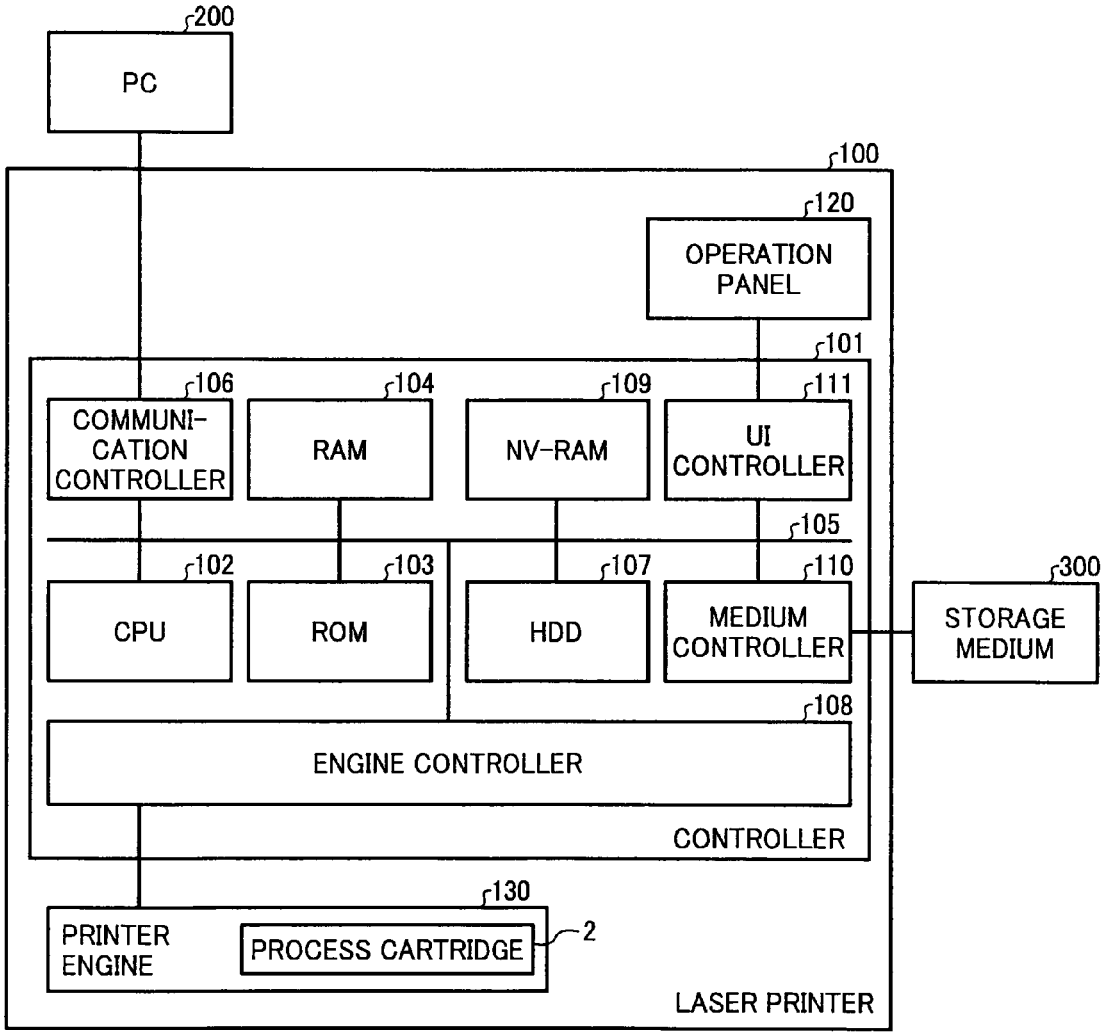
FIG. 2 is a block diagram of a controller in the laser printer shown in FIG. 1.

FIG. 2 is a block diagram of a controller 101 of the laser printer 100. The laser printer 100 includes the controller 101 that controls each unit of the laser printer 100 and executes various control processes such as an image formation process. A printer engine 130 that includes an operation panel 120 and the process cartridge 2 is connected to the controller 101 of the laser printer 100. The operation panel 120 is an operation display unit that receives operations for displayed items and includes a user interface by which status display, modes, and printing conditions of the laser printer 100 can be changed. The printer engine 130 includes the process cartridge 2, the optical writing unit 3, the transfer roller 7, the fixing roller 8 etc. as described above. The printer engine 130 forms an image by the electrophotographic process and outputs the image on recording sheets 5 supplied by the sheet feeding tray 4. Because magnetic ink character recognition (MICR) printing is mainly used for printing checks and drafts, special sheets are used as the recording sheets 5 supplied by the sheet feeding tray 4 for the MICR printing.

The controller 101 is a control mechanism that converts a printing data into a drawing data and outputs the drawing data to the printer engine 130, and modularized as described below. The controller 101 includes a central processing unit (CPU) 102 that controls operations of the laser printer 100. A read only memory (ROM) 103 that stores therein computer programs executed by the CPU 102 and a necessary data, and a random access memory (RAM) 104 that serves as a work area of the CPU 102 are connected to the CPU 102 via an internal bus 105. The RAM 104 is used as a buffer that controls and temporarily stores therein a printing data in page units and also used as a bitmap memory that stores therein video data of the drawing data converted from the printing data stored in the buffer.

Further, a communication controller 106, a hard disk drive (HDD) 107, an engine controller 108, a non-volatile RAM (NV-RAM) 109, a medium controller 110, and a user interface (UI) controller 111 are connected to the CPU 102 via the internal bus 105. An exchange of data between all the units mentioned above is mainly carried out via the internal bus 105.

The NV-RAM 109 is a non-volatile memory that stores therein data used for control by the CPU 102 irrespective of turning on/off of a light source (not shown).

The UI controller 111, which is connected to the operation panel 120, exchanges data with a user interface displayed on the operation panel 120.

The communication controller 106 is a built-in interface card for connecting the laser printer 100 to a local area network (LAN) cable and a universal serial bus (USB) cable. For example, the communication controller 106 is connected to a personal computer (PC) 200, which is an external device, via the LAN cable and performs operations such as receiving printing data etc. from the PC 200 and transmitting print result data etc. to the PC 200.

The HDD 107 stores therein various print document data and other data files etc. as appropriate. Additionally, the HDD 107 stores therein an operating system (OS) and various application programs running on the OS. In the present embodiment, a print processing program as the application program is stored in the HDD 107.

The engine controller 108 is an interface that relays control signals to the printer engine 130 from the CPU 102 and receives engine status signals to be sent to the CPU 102 from the printer engine 130.

The medium controller 110 is an interface or an insertion slot to which a non-volatile storage medium 300 that serves as a detachable external storage media (for example, secure digital (SD) card etc.) is inserted. When the storage medium 300 is inserted into the slot, insertion of the storage medium 300 can be recognized due to voltage change etc. (hot plugging).

In the laser printer 100, when a user turns on the light source, the HDD 107 reads the OS from the RAM 104 and boots the OS. The OS then boots the application programs based on operations by the user, reads data, and stores the data. Further, the application programs are not limited to those run on a predetermined OS. For example, the application programs can cause the OS to execute a part of processes mentioned below. Moreover, the application programs can be included as a part of a set of program files contained in a predetermined application program and a predetermined OS.

Generally, application programs to be installed in the HDD 107 of the laser printer 100 are recorded in the storage medium 300 and the application programs are installed in the HDD 107 from the storage medium 300. Thus, the storage medium 300 can also serve as a storage medium for storing therein the application programs. Moreover, the application programs can also be installed in the HDD 107 from outside via a network.

Although the laser printer 100 includes the HDD 107, the present invention is not to be thus limited. The application programs and the OS can be stored in a computer-readable storage medium such as a semiconductor memory.

Upon receiving a print command from the PC 200 via the communication controller 106 based on the print processing program, the controller 101 of the laser printer,100 having a structure as mentioned above outputs a print start command to the printer engine 130 via the engine controller 108. By repeating such an operation, the printing data from the PC 200 can actually be printed through the printer engine 130.

A printing operation of the printer engine 130 is explained along a flow of the recording sheets 5. The recording sheets 5 stacked in the sheet feeding tray 4 are picked up one by one by the pickup roller 6 and conveyed to the photosensitive body 11. The photosensitive body 11 is rotatably driven in a clockwise direction, a surface of the photosensitive body 11 is charged by the electrostatic roller 12, and an electrostatic latent image of an input image is formed by irradiating the surface of the photosensitive body 11 with laser beams from the optical writing unit 3. The electrostatic latent image is visualized by toner when the photosensitive body 11 rotates and passes by the developing unit 14. The developed image on the photosensitive body 11 is transferred by the transfer roller 7 to the recording sheet 5 conveyed to the photosensitive body 11. Subsequently, the recording sheet 5 is conveyed to the fixing roller 8, the transferred image on the recording sheet 5 is fixed by thermocompression, and delivered outside the laser printer 100.

Figure 3:
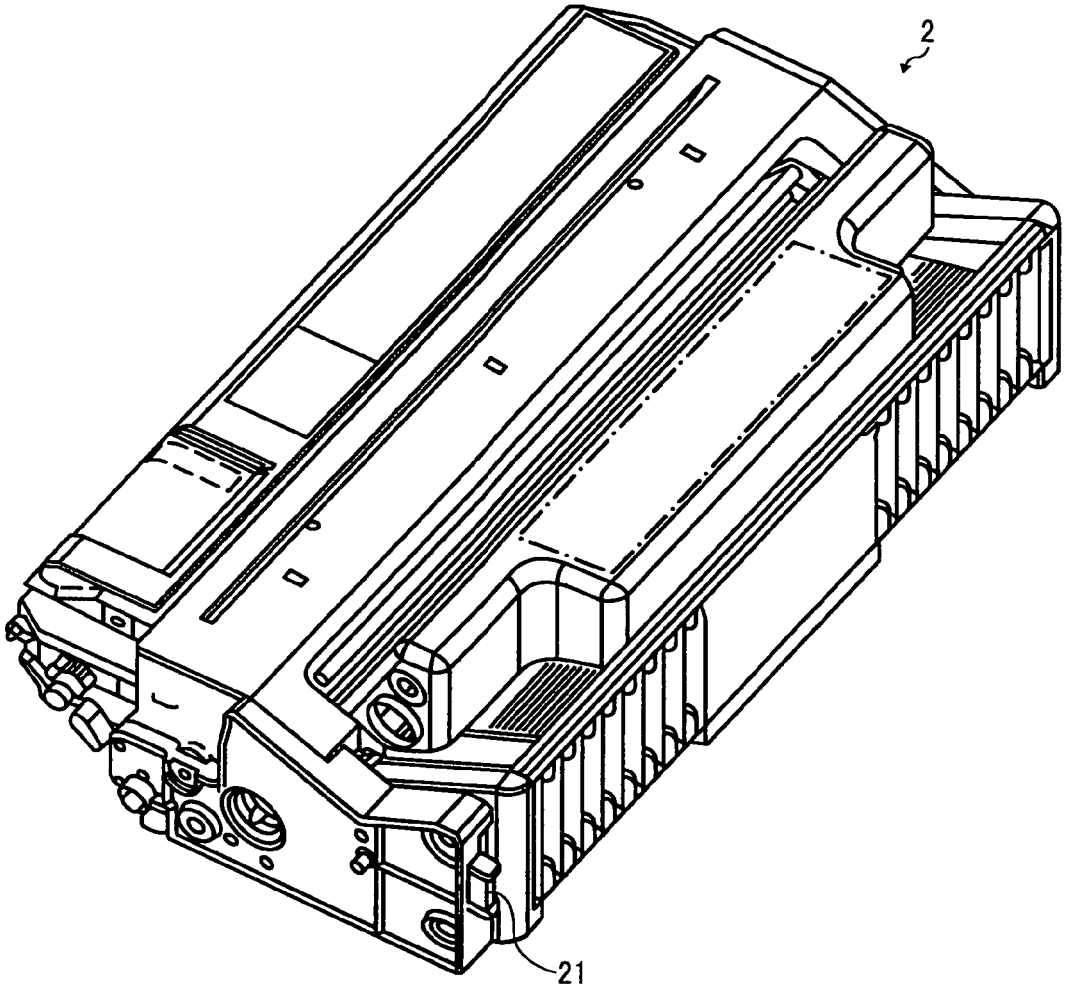
FIG. 3 is a perspective view of an exterior of a process cartridge shown in FIG. 1.

As shown in FIG. 3, a connector 21 that includes an integrated circuit (IC) chip 30 (see FIG. 4) is set to the process cartridge 2. When the process cartridge 2 is mounted inside the main body 1 of the laser printer 100, the connector 21 is coupled as a printer-side connector (not shown) and the IC chip 30 is connected to the controller 101 of the laser printer 100. Thus, the controller 101 executes an image formation control by loading various data from the IC chip 30 of the process cartridge 2.

Figure 4:
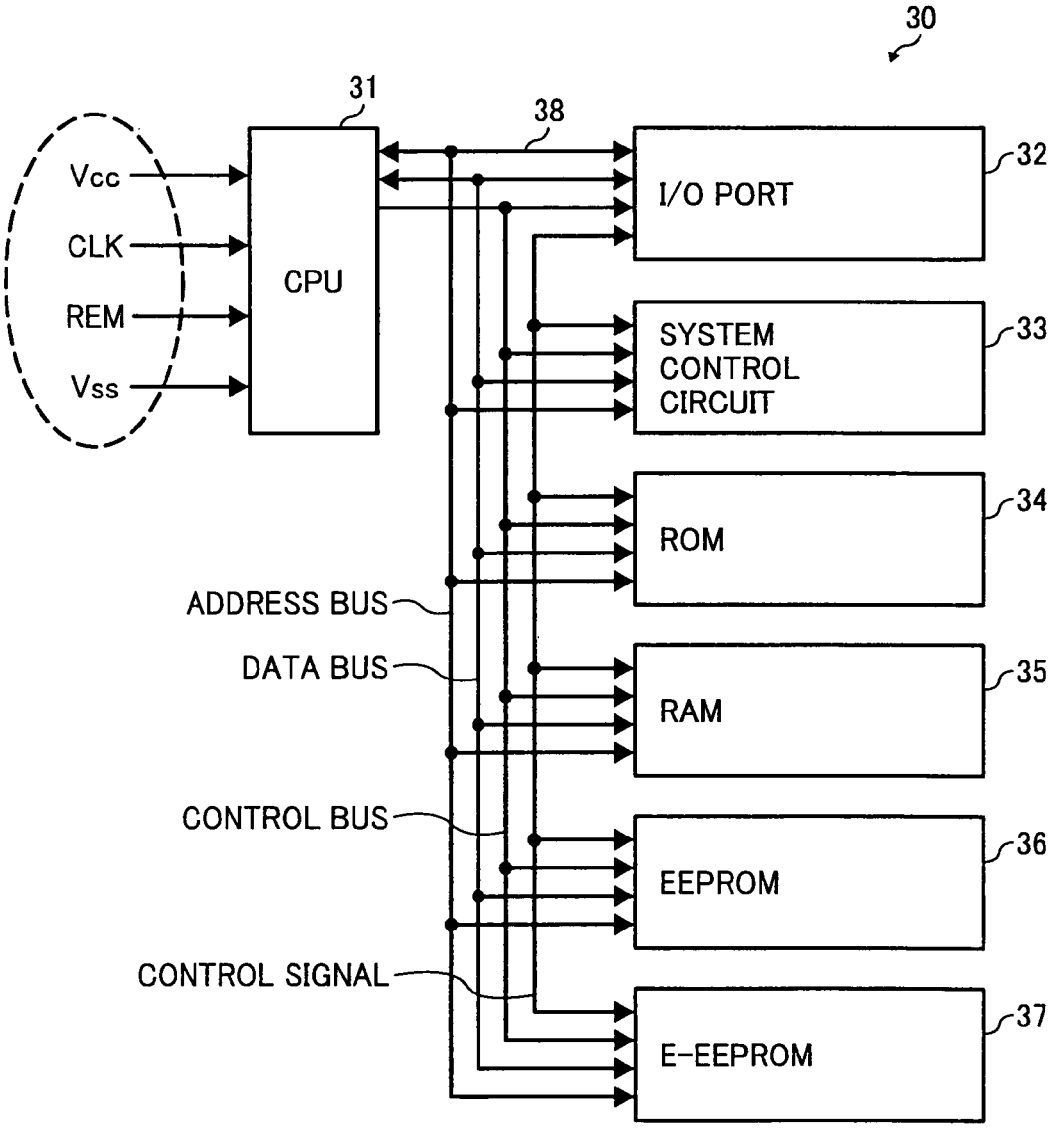
FIG. 4 is a block diagram of hardware configuration of an IC chip installed in a connector shown in FIG. 3.

FIG. 4 is a block diagram of a hardware configuration of the IC chip 30 installed in the connector 21. The IC chip 30 includes, on a base plate, a CPU 31 that functions as a main controlling body, an input-output (I/O) port 32 that is the interface that carries out communication with the laser printer 100 and that complies with International Organization for Standardization (ISO) 7816, a system control circuit 33 that controls an inner portion of the IC chip 30, a ROM 34 that is a storage device that stores therein process programs of the IC chip 30, a RAM 35 that is a working memory for executing process programs, an electrically erasable programmable read only memory (EEPROM) 36 that is a non-volatile memory that stores therein cartridge data necessary for controlling the process cartridge 2, and an emulated-electrically erasable programmable read only memory (E-EEPROM) 37 that is a non-volatile memory that stores therein an exclusive command for writing to the EEPROM. The above units are connected to one another by signal lines 38. When the process cartridge 2 is mounted inside the main body 1 of the laser printer 100 and the power source is turned on, a bias electric power (not shown) is supplied from the laser printer 100 via the I/O port 32 and the IC chip 30 is operated.

The cartridge data necessary for controlling the process cartridge 2 and stored in the EEPROM 36 includes, for example, imaging conditions such as identification numbers, light exposure, an amount of electrostatic charge, and developing bias. The cartridge data can also include a cartridge lot, a date of manufacture, a type, a usage start date, a number of copies, a recycle count, a maximum recycle count, a replacement period of structural components of the process cartridge, a toner lot, a filling amount, and a retention period.

A type of the process cartridge 2 among the cartridge data stored in the EEPROM 36 is explained below. The process cartridge 2 used in the present embodiment is either a "normal cartridge" or a "MICR cartridge". Each of the two cartridges employs each different toner that is stored in the toner storage unit 14*a*. MICR stands for magnetic ink character recognition. In MICR, a unique font called an MICR font, which uses a magnetic toner, is printed on checks etc. and MICR characters printed on the checks are read and sorted out by an apparatus called an MICR reader-sorter. Thus, the magnetic toner is stored in the toner storage unit 14*a* of the process cartridge 2 of the "MICR cartridge". On the other hand, a general toner is stored in the toner storage unit 14*a* of the process cartridge 2 of the "normal cartridge".

A characteristic function performed by the laser printer 100 when the CPU 102 runs based on the print processing program is explained below. A characteristic of the laser printer 100 is that when printing of a job that does not comply with the type of the process cartridge 2 mounted on the main body 1 is demanded, the laser printer 100 inhibits printing with the process cartridge 2.

Figure 5:
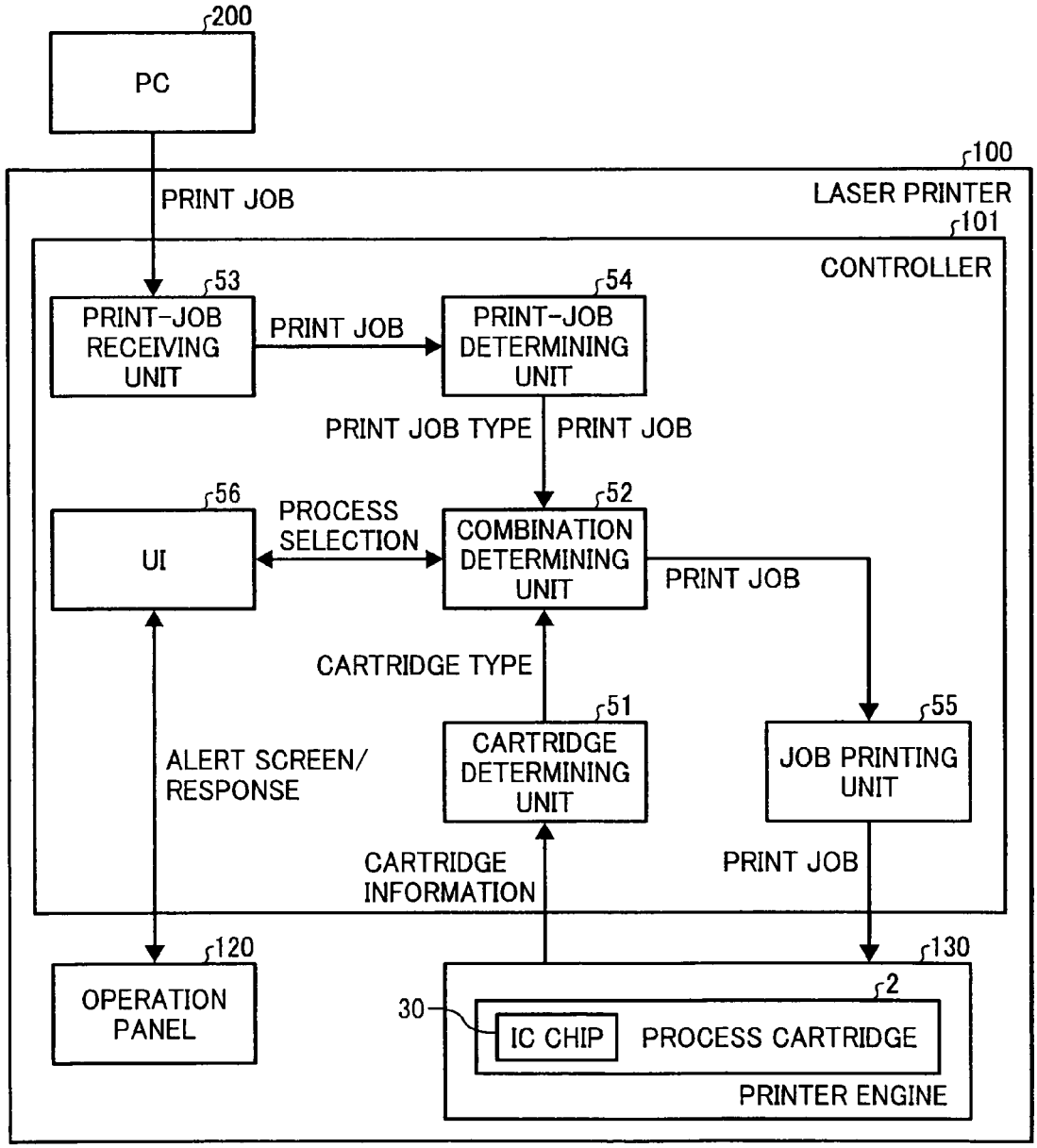
FIG. 5 is a functional block diagram of the controller for performing a printing inhibition process.

FIG. 5 is a functional block diagram of the controller 101 for performing a printing inhibition process. The controller 101 includes a cartridge determining unit 51, a combination determining unit 52, a print-job receiving unit 53, a print-job determining unit 54, a job printing unit 55, and a UI 56. Due to an operation of the CPU 102 based on the print processing program, the cartridge determining unit 51 functions as a cartridge determining unit, the combination determining unit 52 functions as an inhibiting unit, and the print-job determining unit 54 functions as a print-job determining unit.

The cartridge determining unit 51 retrieves the cartridge data containing the type ("normal cartridge" or "MICR cartridge") of the process cartridge 2 mounted inside the main body 1 from the IC chip 30 of the process cartridge 2 and determines whether the type of the process cartridge 2 is "normal cartridge" or "MICR cartridge". Further, a determination result of the type of the process cartridge 2 is recorded in the NV-RAM 109 and can be checked from the user interface that displays a mounted cartridge type of the "normal cartridge" or the "MICR cartridge" on the operation panel 120. The cartridge determining unit 51 outputs the determination result of the cartridge type to the combination determining unit 52.

Upon receiving a print job from the PC 200, the print-job receiving unit 53 outputs the received print job to the print-job determining unit 54.

The print-job determining unit 54 determines a type of the print job received from the print-job receiving unit 53. The MICR data indicating that the print job is an MICR print job is prior added to the MICR print job by the PC 200. If the PC 200 is a dedicated machine that deals with checks and drafts, the MICR data can always be added to a print job. Otherwise, whether to add the MICR data to a print job is determined by a user. For example, when a driver is used, checkboxes for MICR printing can be provided on a driver screen and checks can be entered in the checkboxes by a user as appropriate. The MICR data is an MICR password added at a predetermined position (for example, at a head) of the printing data. The MICR password is set to necessarily include a predetermined character string such as "MICRPW=**". The MICR password is prior determined for the laser printer 100, and the password of the laser printer 100 and the MICR password added to the printing data are verified to perform authentication. The MICR password can be modified by accessing the laser printer 100 from the operation panel 120** or a Web browser.

The print-job determining unit 54 outputs to the combination determining unit 52 the print job received from the print-job receiving unit 53 and the determined type of the print job.

Based on a combination of the print job type from the print-job determining unit 54 and the cartridge type from the cartridge determining unit 51, the combination determining unit 52 determines whether a printing process is allowed.

Figures 6, 7:
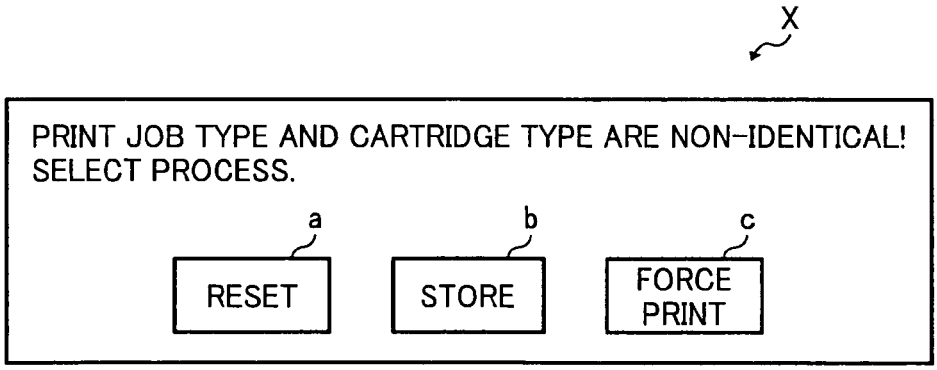
FIG. 6 is a table containing a correspondence between a print job type and a cartridge type with indication whether a printing process is allowed.
FIG. 7 is an example of an alert screen to be displayed on an operation panel shown in FIG. 5.

FIG. 6 is a table containing a correspondence between a print job type and a cartridge type with indication whether a printing process is allowed. According to the table that is shown in FIG. 6 and that is included in the print processing program, when the print job type and the cartridge type are identical, printing is allowed ("allowed" in FIG. 6) without any problems. On the other hand, printing of the MICR print job using the process cartridge 2 of the "normal cartridge" is inhibited ("inhibited" in FIG. 6). This is because a printed material by the MICR print job using the "normal cartridge" and a printed material by the MICR print job using the "MICR cartridge" look alike and misprint of the MICR print job using the "normal cartridge" should be prevented to ensure credibility of a publisher. Considered that a normal print job is printed using the process cartridge 2 of the "MICR cartridge", although the print job type and the cartridge type are non-identical, printing of the normal print job using the process cartridge 2 of the "MICR cartridge" hardly causes problems, and therefore, printing is allowed ("allowed" in FIG. 6).

Upon determining, based on the combination of the print job type and the cartridge type, that printing is allowed, the combination determining unit 52 outputs to the job printing unit 55 the print job for which printing is allowed. Upon receipt of the print job, the job printing unit 55 outputs a print start command to the printer engine 130 via the engine controller 108.

On the other hand, upon determining, based on the combination of the print job type and the cartridge type, that printing is inhibited, in other words, when the combination of the MICR print job and the process cartridge 2 of the "normal cartridge" is used, the combination determining unit 52 instructs the UI 56 to display an alert screen, which is a warning-confirmation screen, that displays warnings or confirmation and alert messages. Upon receiving the instruction, the UI 56 displays an alert screen X, which is shown in FIG. 7, on the user interface displayed on the operation panel 120. In the alert screen X, notification that the print job type and the cartridge type are non-identical (the combination of the print job type and the cartridge type is inappropriate) and selectable processes for the print job are displayed. Any one of a "reset" button a, a "store" button b, and a "force print" button c can be selected on the alert screen X.

The UI 56 outputs a response (a selection response of any one of the "reset" button a, the "store" button b, and the "force print" button c) received via the alert screen X to the combination determining unit 52.

The combination determining unit 52 executes a process corresponding to the response received via the alert screen X. When a selection operation of the "reset" button a is received, the combination determining unit 52 executes a process of resetting the print job. When the selection operation of the "store" button b is received, the combination determining unit 52 executes a process of temporarily storing the print job in the HDD 107 etc. At that time, if that the process cartridge 2 of the "MICR cartridge" is mounted, the printing process can be executed again by reading the print job stored in the HDD 107 etc. When the selection operation of the "force print"

button c is received, the combination determining unit 52 executes a process of printing the MICR print job using the process cartridge 2 of the "normal cartridge", as a test printing etc. However, as mentioned above, when the MICR print job is printed using the process cartridge 2 of the "normal cartridge", printing material needs to be handled with-care to ensure credibility of a publisher.

Figure 8:
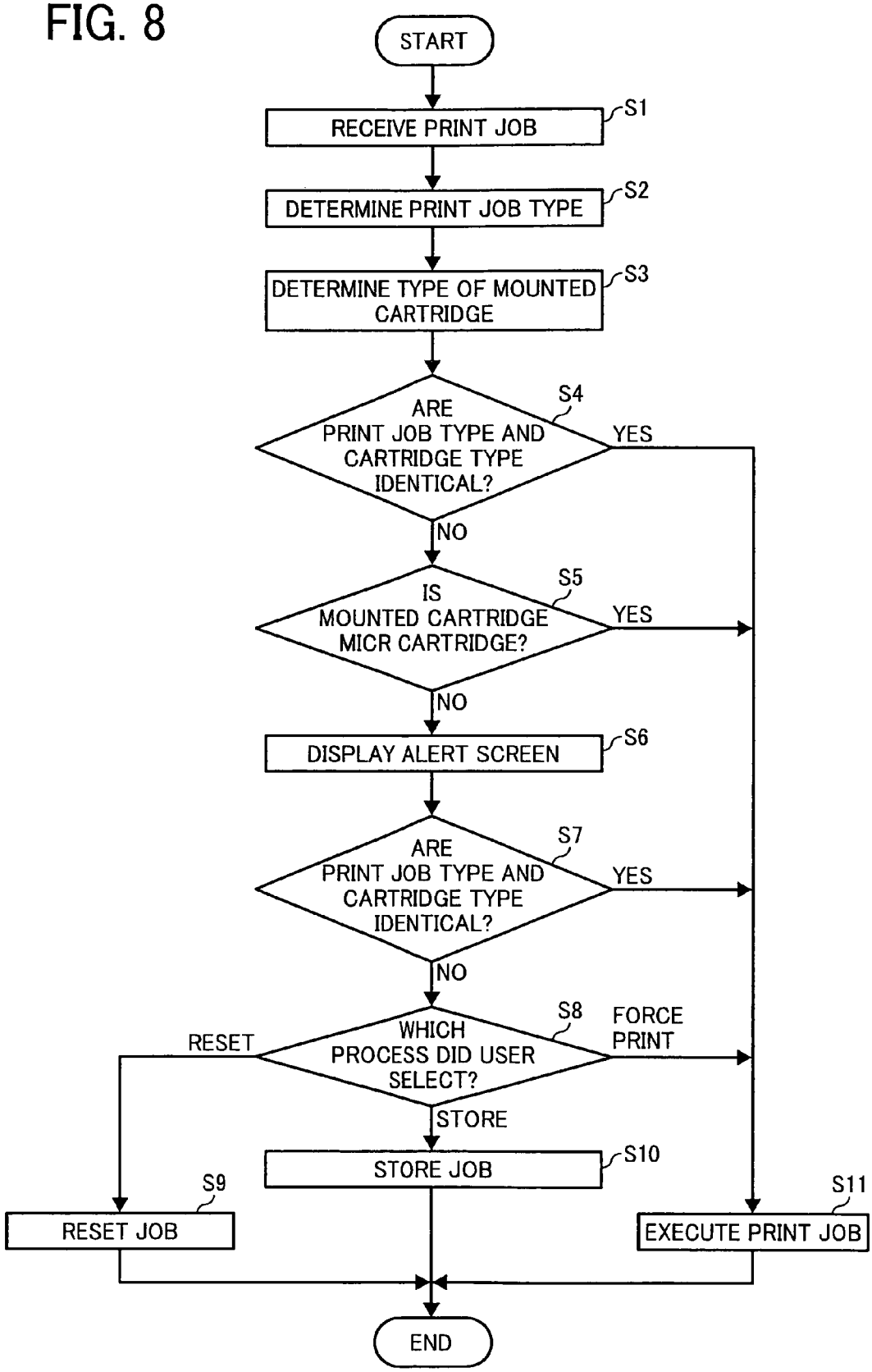
FIG. 8 is a flowchart of a process procedure of the printing process performed by the controller shown in FIG. 5.

FIG. 8 is a flowchart of a process procedure of the printing process. Upon receiving the print job from the PC 200 (Step S1), the print job type is determined (Step S2), and also the cartridge data that includes the type ("normal cartridge" or "MICR cartridge") of the process cartridge 2 that is mounted is retrieved from the IC chip 30 of the process cartridge 2 mounted inside the main body 1 of the laser printer 100 (Step S3).

At Step S4, it is determined whether the print job type and the cartridge type are identical.

If the print job type and the cartridge type are identical (Yes at Step S4), the printing process is immediately executed (Step S11).

When it is determined that the print job type and the cartridge type are non-identical (No at Step S4) and if the process cartridge 2 mounted on the main body 1 is the "MICR cartridge" (Yes at Step S5), the normal print job can be printed using the process cartridge 2 of the "MICR cartridge" without any problems, and therefore, the printing process is immediately executed (Step S11).

On the other hand, if it is determined that the print job type and the cartridge type are non-identical (No at Step S4) and if the process cartridge 2 mounted on the main body 1 is not the "MICR cartridge" (No at Step S5), the alert screen X as shown in FIG. 7 is displayed on the user interface of the operation panel 120 (Step S6).

If the process cartridge 2 is replaced with a different type when the alert screen X is being displayed, and if the print job type and the cartridge type are identical (Yes at Step S7), the printing process is immediately executed (Step S11).

On the other hand, if the process cartridge 2 is not replaced when the alert screen X is being displayed (No at Step S7) and any one of processes corresponding to the buttons a, b, and c of the alert screen X is selected (Step S8), the process corresponding to the selected button is executed.

When a selection of a process corresponding to the "reset" button a is received, the process of resetting the print job is executed (Step S9).

When a selection of a process corresponding to the "store" button b is received, the process of temporarily storing the print job in the HDD 107, etc. is executed (Step S10). At that time, if the process cartridge 2 mounted on the main body 1 is the "MICR cartridge", the printing process can be executed again by reading the stored print job.

When a selection of a process corresponding to the "force print" button c is received, the printing process is immediately executed (Step S11). At that time, the process of printing the MICR job using the process cartridge 2 of the "normal cartridge" is executed as a test printing etc. However, as described above, when the MICR print job is printed using the process cartridge 2 of the "normal cartridge", the printing material needs to be handled with care to ensure credibility of a publisher.

Thus, according to the present embodiment, the type of the cartridge that is currently accommodated inside the main body and the type of the print job that is received from an external device are determined. If the print job type and the cartridge type do not match, the image formation process based on that print job is inhibited.

Specifically, when the cartridge type is the MICR cartridge used in the MICR and the print job type is not the MICR print job, the image formation process can be inhibited.

According to the present embodiment, when it is determined that the print job type and the cartridge type are non-identical and if the process cartridge 2 mounted on the main body 1 is not the "MICR cartridge", the alert screen X as shown in FIG. 7 is displayed on the user interface displayed on the operation panel 120. However, the present invention is not to be thus limited.

Figure 9:
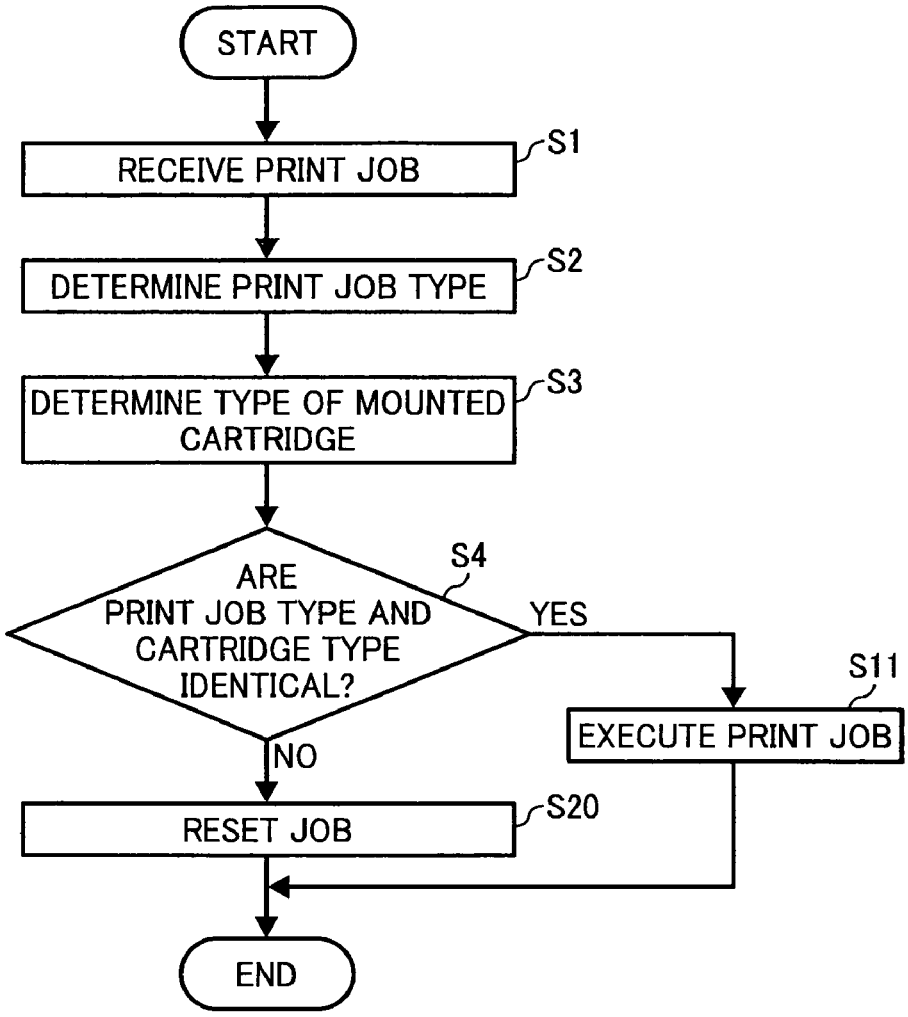
FIG. 9 is a flowchart of another process procedure of the printing process.
Figure 10:
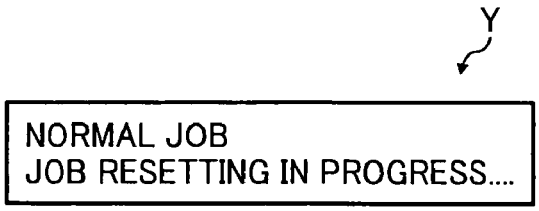
FIG. 10 is another example of the alert screen.

For example, as shown in FIG. 9, if it is determined that the print job type and the cartridge type are non-identical (No at Step S4), the process of resetting the print job can be immediately executed (Step S20). At that time, an alert screen Y as shown in FIG. 10 that notifies resetting of the print job can be displayed on the user interface displayed on the operation panel 120.

Figure 11:
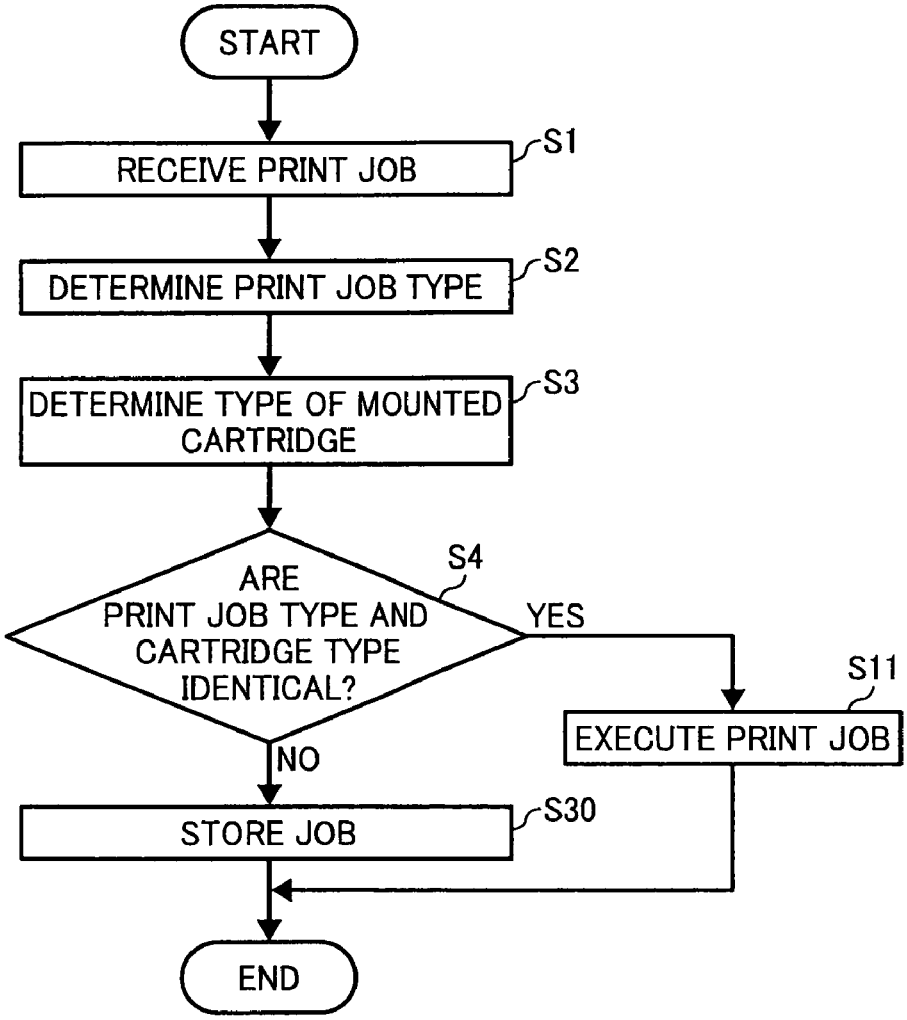
FIG. 11 is a flowchart of still another process procedure of the printing process.
Figure 12:
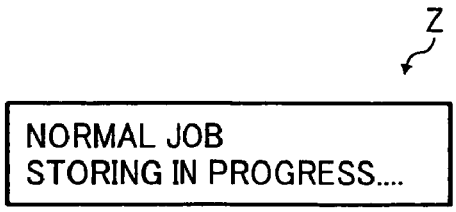
FIG. 12 is still another example of the alert screen.

As shown in FIG. 11, if it is determined that the print job type and the cartridge type are non-identical (No at Step S4), the process of temporarily storing the print job in the HDD 107, etc. can be immediately executed (Step S30). At that time, an alert screen Z as shown in FIG. 12 that notifies storing of the print job can be displayed on the user interface displayed on the operation panel 120.

According to the present embodiment, the laser printer 100 that includes the process cartridge 2 that forms the images by the electrophotographic process and the printer engine 130 is applied to an image forming apparatus. However, the present invention is not to be thus limited. For example, a printer that includes an ink cartridge containing the magnetic ink, and a printer engine that forms the images by an inkjet method using the ink cartridge can be employed.

According to an aspect of the present invention, a type of a cartridge that is currently accommodated inside a main body and a type of a print job that is received from an external device are determined. If the print job type and the cartridge type do not match, an image formation process based on that print job is inhibited.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a main body to detachably accommodate a cartridge that is used for image formation;

a cartridge determining unit to determine whether or not a cartridge type of a cartridge accommodated in the main body is a magnetic ink character recognition (MICR) cartridge type;

a print-job determining unit to determine whether or not a print job type of a print job is an MICR print job type by determining whether MICR data is present in the print job; and an inhibiting unit to inhibit, upon the determinations indicating that the print job type is the MICR print job type and the cartridge type is not the MICR cartridge type, an image formation process.

2. The image forming apparatus according to claim 1, wherein the inhibiting unit inhibits an image formation process upon the determinations indicating that the cartridge type is the MICR cartridge type and the print job type is not the MICR print job type.

3. The image forming apparatus according to claim 1, wherein the inhibiting unit resets the print job to inhibit an image formation process.

4. The image forming apparatus according to claim 1, wherein the inhibiting unit stores the print job in a storage unit to inhibit an image formation process.

5. The image forming apparatus according to claim 1, further comprising:

an operation display unit to receive an operation for an item displayed thereon; and a screen display unit to display a warning-confirmation screen on the operation display unit, wherein the inhibiting unit is configured to notify the screen display unit of mismatching of the print job type and the cartridge type, cause the screen display unit to display the warning-confirmation screen containing a selectable process for a print job on the operation display unit, and inhibit an image formation process based on a process received via the warning-confirmation screen.

6. The image forming apparatus according to claim 5, wherein the selectable process is a process of resetting the print job.

7. The image forming apparatus according to claim 5, wherein the selectable process is a process of storing the print job.

8. The image forming apparatus according to claim 5, wherein the selectable process is a process of executing an image formation process based on the print job.

9. The image forming apparatus according to claim 5, wherein the inhibiting unit stops, upon determining that the print job type and the cartridge type are caused to be matched by replacing the cartridge when the warning-confirmation screen is being displayed, inhibiting of an image formation process and executes an image formation process based on the print job.

10. The image forming apparatus according to claim 1, wherein the cartridge determining unit is configured to retrieve the cartridge type from an integrated circuit chip installed in the cartridge accommodated in the main body.

11. The apparatus of claim 1, wherein the MICR data is an MICR password added at a location in the print job.

12. A computer program product comprising a computer usable medium having computer readable program codes embodied in the medium that, when executed, causes a computer to execute:

determining whether or not a cartridge type of a cartridge that is detachably accommodated in a main body for use in image formation is a magnetic ink character recognition (MICR) cartridge type;

determining whether or not a print job type of a print job is an MICR print job type by determining whether MICR data is present in the print job; and inhibiting, when the print job type is the MICR print job type and the cartridge type is not the MICR cartridge type, an image formation process.

13. The computer program of claim 12, wherein determining whether magnetic ink character recognition data is present comprises determining whether an MICR password is present at a location in the print job.

14. A printing inhibiting method comprising:

determining whether or not a cartridge type of a cartridge that is detachably accommodated in a main body for use in image formation is a magnetic ink character recognition (MICR) cartridge type;

determining whether or not a print job type of a print job is an MICR print job type by determining whether MICR data is present in the print job; and inhibiting, if the print job type is the MICR print job type and the cartridge type is not the MICR cartridge type, an image formation process.

15. The printing inhibiting method according to claim 14, wherein the inhibiting includes inhibiting an image formation process upon the determinations indicating that the cartridge type is the MICR cartridge type and the print job type is not the MICR print job type.

16. The printing inhibiting method according to claim 14, wherein the inhibiting includes resetting the print job to inhibit an image formation process.

17. The printing inhibiting method according to claim 14, wherein the inhibiting includes storing the print job in a storage unit to inhibit an image formation process.

18. The printing inhibiting method according to claim 14, wherein the inhibiting includes notifying mismatching of the print job type and the cartridge type, causing a warning-confirmation screen containing a selectable process for a print job to be displayed on an operation display unit, and inhibiting an image formation process based on a process received via the warning-confirmation screen.

19. The printing inhibiting method according to claim 18, wherein the selectable process is a process of resetting the print job.

20. The printing inhibiting method according to claim 18, wherein the selectable process is a process of storing the print job.

21. The printing inhibiting method according to claim 18, wherein the selectable process is a process of executing an image formation process based on the print job.

22. The printing inhibiting method according to claim 18, wherein the inhibiting includes stopping, upon determining that the print job type and the cartridge type are caused to be matched by replacing the cartridge when the warning-confirmation screen is being displayed, inhibiting of an image formation process and executing an image formation process based on the print job.

23. The print inhibiting method of claim 14, wherein MICR data comprises an MICR password at a location in the print job.

* * * * *